United States Patent [19]

Sykora et al.

[11] 4,172,972

[45] Oct. 30, 1979

[54] LOW COST MINIATURE CASELESS SLIDE-ACTION ELECTRIC SWITCH HAVING STIFFENED BASE MEMBER

[75] Inventors: Allan J. Sykora, Cary; Dudley H. Campbell, Raleigh, both of N.C.

[73] Assignee: Stackpole Components Company, Raleigh, N.C.

[21] Appl. No.: 898,075

[22] Filed: Apr. 20, 1978

[51] Int. Cl.[2] ..... B41B 9/00; H01H 1/36

[52] U.S. Cl. ..... 200/164 R; 200/16 D

[58] Field of Search ..... 200/16 D, 164 R

[56] References Cited

U.S. PATENT DOCUMENTS

| | | | |
|---|---|---|---|
| 3,219,784 | 11/1965 | Toruk et al. | 200/164 R |
| 3,328,540 | 6/1967 | Zoda et al. | 200/16 D |
| 4,012,608 | 3/1977 | Lockard | 200/164 R |
| 4,016,378 | 4/1977 | Arthur | 200/16 D |

*Primary Examiner*—Steven L. Stephan

*Attorney, Agent, or Firm*—Charles W. Helzer

[57] ABSTRACT

A low cost miniature caseless slide action electric switch comprised by a relatively flat insulator base member of substantially uniform thickness throughout its length and breadth and fabricated from a molded thermoplastic material. A plurality of electric terminals extend through the lower one of the flat surfaces and are engagable from the opposite upper flat surface of the insulator base member. The insulator base member further includes at least two sets of opposed, resilient, slide contact housing side retaining members integrally formed on the respective side edges near the ends of the flat insulator base member. The side retaining members extend outwardly in a direction normal to the flat surfaces on the same side of the insulator base member as the upper flat surface. The insulator base member further includes integrally formed stiffening channel portions extending between corresponding side retaining members of the respective opposite sets formed on the same side edge of the insulator base member. At least one electrically conductive slide contact member is supported on the upper flat surface of the insulator base member for engaging the respective electric terminals and making or breaking electrically conducting paths through the terminals. A slidable contact housing member of insulating material is provided and includes at least one cavity for retaining the slide contact member in place on the upper flat surface of the insulator base member. The slidable contact housing member is engaged by and slidably retained in place on the upper surface of the insulator base member by the sets of opposed, resilient, slide contact housing side retaining members. Stops are provided for the slidable contact housing member for restraining movement of slide contact member between predetermined end positions.

27 Claims, 17 Drawing Figures

Fig. 1.
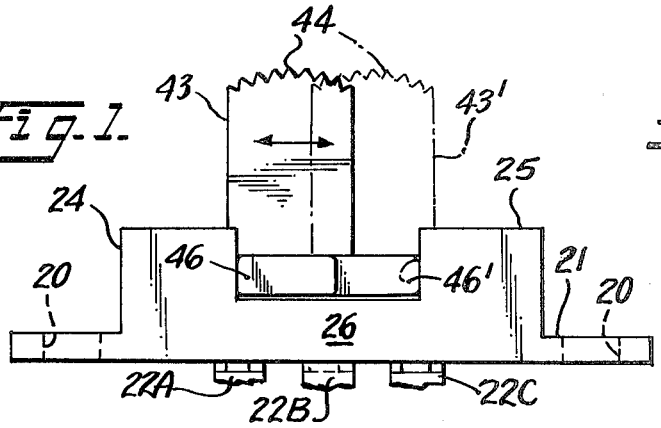
Fig. 2.
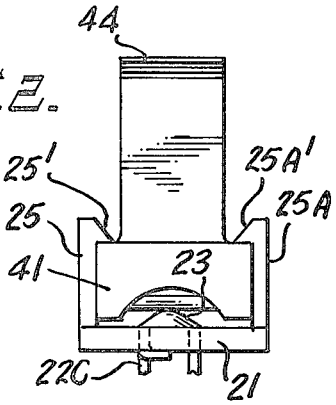
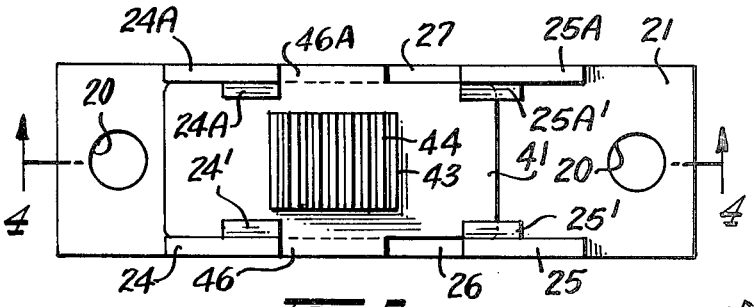
Fig. 3.
Fig. 4.
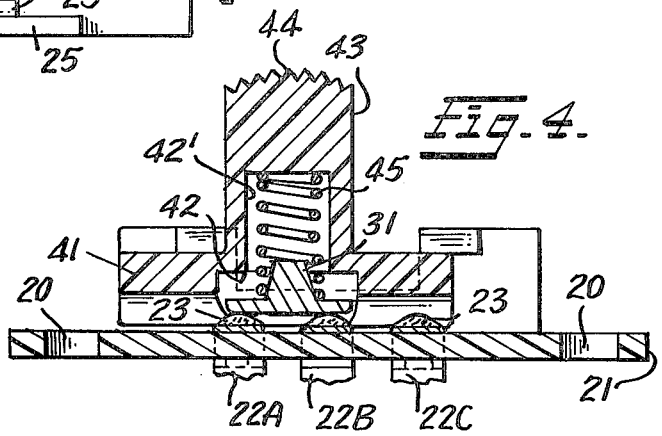
Fig. 5.
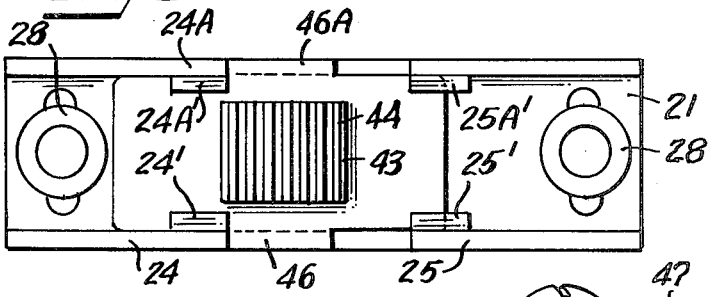
Fig. 6.
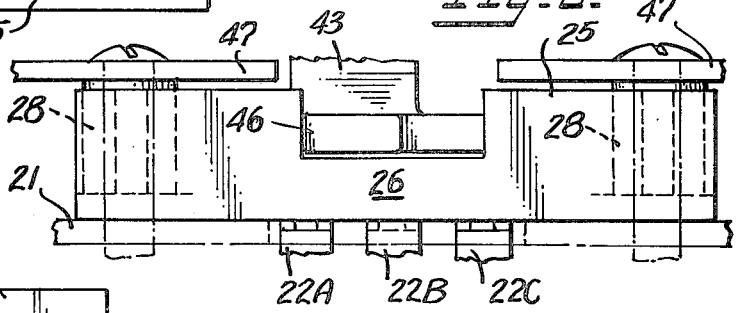
Fig. 7.
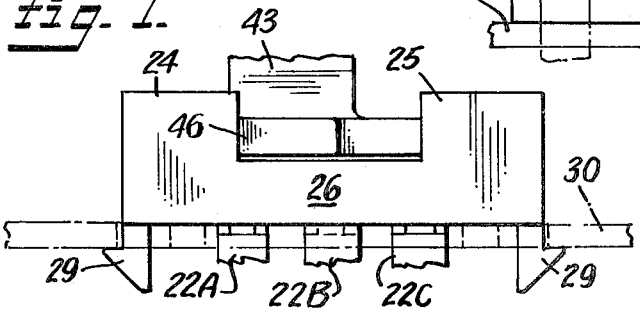

Fig. 8.
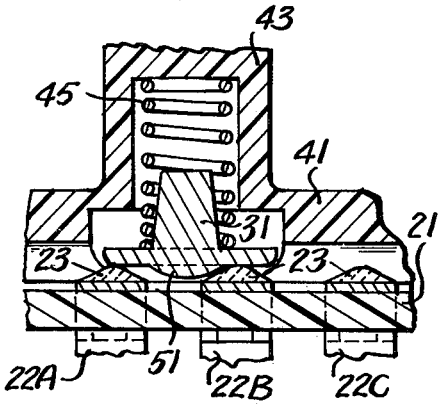
Fig. 10.
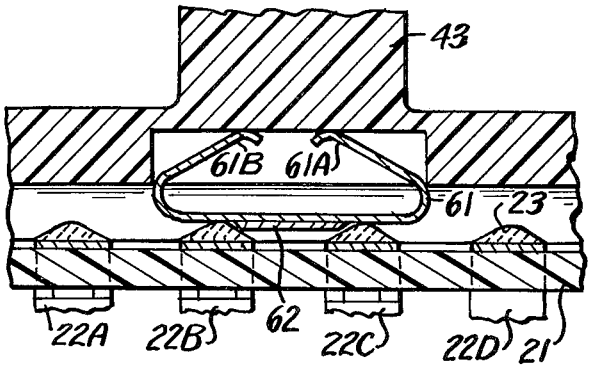
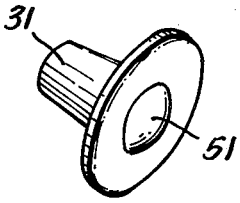
Fig. 9.
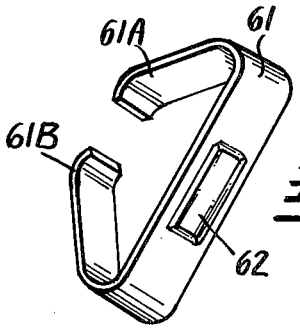
Fig. 11.
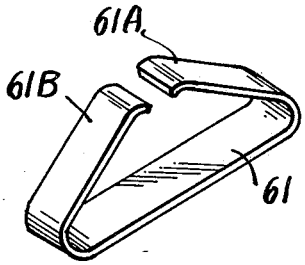
Fig. 12.
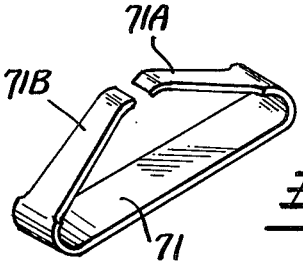
Fig. 13.
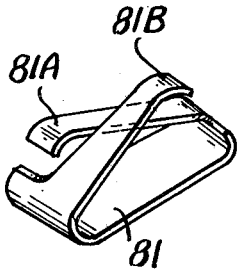
Fig. 14.

LOW COST MINIATURE CASELESS SLIDE-ACTION ELECTRIC SWITCH HAVING STIFFENED BASE MEMBER

BACKGROUND OF INVENTION

1. Field of Invention

This invention relates to miniaturized, slide-action electric switches of the type employed for switching devices on television and radio sets and the like and in particular to such switches which are caseless in that they do not require the use of an outer metal casing.

More specifically, the invention relates to miniaturized, caseless electric switches of the above generally described type which employ a minimum number of parts and are comparatively easy and inexpensive to manufacture and sell and yet are reliable in operation.

2. Prior Art Problem

U.S. Pat. No. 3,983,341—issued Sept. 28, 1976; U.S. Pat. No. 4,016,378—issued Apr. 5, 1977 and U.S. Pat. No. 4,052,580—issued Oct. 4, 1977 all describe miniaturized electric switches of the above generally described type which do not require the use of an external metal casing or housing and hence are lighter and cheaper to manufacture and sell than similar switches which do require the use of an external metal casing such as those described in U.S. Pat. No. 3,072,757—issued Jan. 8, 1963, for example. Similar miniaturized, caseless electric switches are described in West German Utility Model Application (Gebrauchsmuster) No. 7344516 published Mar. 28, 1974 and in Japanese Utility Model Publication No. 13168/74 published Apr. 1, 1974. All of these known prior art patents and publications disclose miniaturized, caseless electric switches which employ a relatively thin, flat insulator base member of molded thermoplastic or the like on which electric terminals are mounted. A molded plastic slide housing having yieldable side skirts with hooks on the end thereof snaps over the base member and contains a slidable contact member which then is slid back or forth over the base member to actuate the switch. A difficulty encountered with the known switches of this design, is that the relatively thin, flat insulator base member is comparatively weak and is subject to fracture or bending during operation of the switch in service.

U.S. Pat. No. 4,016,401—issued Apr. 5, 1977, describes a miniaturized, caseless electric switch which utilizes both an insulator base member and slide housing of molded plastic construction both of which are of substantial thickness and not readily bent or fractured. However, the electric switch described in this patent requires a specially designed annular switch contact and elastically yieldable positioning element arrangement in addition to the requirement of a complex configured and expensive-to-mold shape for both the base insulator and slide housing members. Consequently, the switch is comparatively more expensive to manufacture and sell than the switches described in the preceding paragraph. The present invention was devised in order to overcome the objections to the above briefly described prior art miniaturized, slide-action, caseless electric switches, and to make available to the art an improved, low cost, slide-action, caseless switch which overcomes the objectionable features of the known designs and yet is relatively inexpensive to manufacture and assemble.

SUMMARY OF INVENTION

It is therefore a primary object of the present invention to provide a new and improved, miniaturized, caseless, slide-action electric switch which employs a minimum number of relatively simple and inexpensive to fabricate component parts, is easy to assemble during manufacture, and yet is comparatively rugged and durable after assembly so as to provide reliable operation in service.

In practicing the invention, a caseless slide-action electric switch is provided which comprises a relatively thin, flat, insulator base member of thermoplastic material or the like and of simple molded construction with substantially uniform thickness throughout its length and breadth. A plurality of electric terminals extend through the lower one of the flat surfaces of the insulator base member and are engageable from the opposite (upper) flat surface thereof. The insulator base member includes at least two sets of opposed, resilient, slide contact housing side retaining members integrally formed on the respective side edges near the ends of the insulator base member and extending outwardly in a direction normal to the said opposite (upper) flat surface and on the same side of the insulator base member as the opposite (upper) flat surface. The insulator base member further includes integrally formed stiffening channel portions extending between corresponding side retaining members of the respective opposed sets formed on the same side edge of the insulator base member. At least one electrically conductive slide contact member is slidably supported on the opposite (upper) flat surface of the insulator base member for engaging respective electric terminals and making or breaking electrically conducting paths through the terminals. A slidable contact housing member of molded insulating material such as thermoplastic, is provided and has at least one cavity formed therein for retaining the slide contact member in place on the said opposite (upper) flat surface of the insulator base member. The slidable contact housing member is engaged by and slidably retained in place on the said opposite (upper) surface of the insulator base member by the sets of opposed resilient slide contact housing side retaining members. The switch is completed by stop means interacting with the slidable contact housing member and the base member for restraining movement of the slide contact member between predetermined end positions. If desired, detent means for locating the slide contact member in a selected one of two or more positions, also may be included.

The resilient slide contact housing side retaining members preferably have internally tapering hooked end portions formed at the ends thereof for allowing the slidable contact housing member to be snapped into place readily over the said opposite (upper) flat surface of the insulator base member and thereafter slidably retaining the contact housing member along with the slide contact member mounted in position on the insulator base member. The stop means may comprise an integrally formed boss on the slide contact member which engages and is stopped by the resilient side clamping members at opposite ends of travel of the slide contact housing member. The detent means may comprise coacting pimples formed on the contact member and the ends of the terminals which extend through the insulator base member, respectively, to position the slide contact member and slide contact housing member in any one of the total number of positions available in the switch. Alternatively, the detent means may comprise coacting bosses and depressions formed on the underside of the hooked end portions of the slide housing side retaining members and the top of the slidable contact housing member, respectively. The slide contact member may comprise a slug contact coacting with a coil spring compressed within the cavity on the slide contact housing member for pressuring the slug contact into positive electrical engagement with the ends of the terminals extending through the insulator base member. Alternatively, the slide contact member may comprise a spring contact member which provides self-pressuring of the contact member into positive engagement with the electric terminals.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the several figures are identified by the same reference character, and wherein:

FIG. 1 is a side elevational view of a low cost, miniature, caseless, slide-action electric switch constructed according to the present invention;

FIG. 2 is an end elevational view of the switch shown in FIG. 1;

FIG. 3 is a plan view of the electric switch shown in FIGS. 1 and 2;

FIG. 4 is a longitudinal vertical sectional view taken on the line 4—4 of FIG. 3;

FIG. 5 is a plan view of a modified form of the electric switch which includes mounting bosses for mounting the switch on a supporting structure;

FIG. 6 is a fragmentary, side elevational view of the modified form of the switch shown in FIG. 5;

FIG. 7 is a fragmentary side elevation view of still a different modification that is designed for ready mounting on printed circuit boards;

FIG. 8 is a partial, fragmentary side elevational view of another form of the switch illustrating a different contact arrangement from that shown in FIG. 4 and wherein detenting of the slide switch is achieved through the slide contact member;

FIG. 9 is a perspective view showing the construction of a self-detenting slug contact member suitable for use in the switch arrangement of FIG. 8;

FIG. 10 is a partial, fragmentary sectional view of still another form of the slide switch according to the invention illustrating its use with a spring contact member which is self-detenting;

FIG. 11 is a perspective view of the self-detenting spring contact member used in the arrangement shown in FIG. 10;

FIG. 12, FIG. 13 and FIG. 14 are perspective views of alternative spring contact members which could be employed in a slide contact switch such as that shown in FIG. 4 wherein detenting is achieved by a boss formed on the slide contact housing member.

DETAILED DESCRIPTION OF PREFERRED EMBODIMENTS

Figure 15:
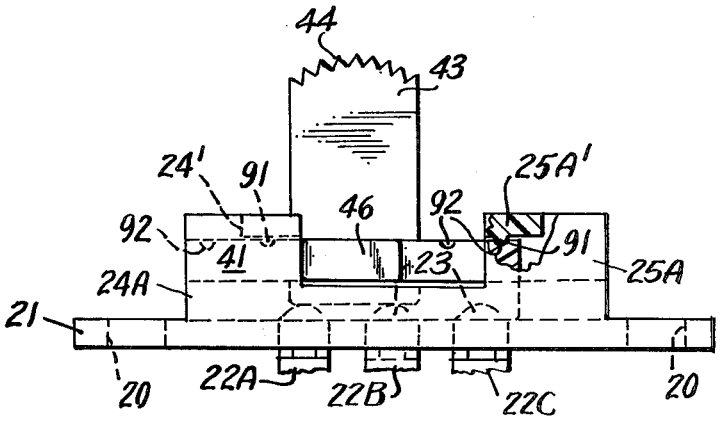
FIG. 15, FIG. 16 and FIG. 17 are side elevation, plan and end views, respectively, of still another embodiment of the switch wherein detenting is achieved by coacting bosses and recesses formed on the ends of the resilient side retaining members and the slide contact housing member, respectively.

FIG. 1 is a side elevational view of a low cost, miniature, caseless, slide-action electric switch constructed according to the invention. As best shown in FIG. 1, considered in conjunction with FIGS. 2 and 3, the caseless slide-action electric switch is comprised by a relatively thin, flat, insulator base member 21 of substantially uniform thickness throughout its length and breadth. The base member 21 may be formed of a molded plastic material such as a thermoplastic which is relatively hard but not brittle and somewhat resilient for reasons to be explained more fully hereafter. The base member 21 has a plurality of electric terminals shown at 22A, 22B, and 22C which extend through the bottom flat surface thereof and are engagable from the opposite upper flat surface of the base member as best seen in FIGS. 2 and 4 of the drawings. The ends of the electric terminals extending through the flat insulator base member 21 are bent over, crimped or otherwise secured to the flat insulator base member.

The insulator base member 21 has at least two sets of opposed, resilient slide contact housing side retaining members shown at 24, 24A and 25, 25A. The side retaining members 24, 24A and 25, 25A are integrally formed on the respective side edges near the ends of the insulator base member 21 in a manner such that they extend outwardly in a direction normal to the upper, opposite flat surface of the base member 21 and on the same side of the base member as the engagable ends 23 of electric terminals 22A, 22B, 22C. As best seen in FIGS. 2 and 3 of the drawings, the resilient side retaining members 24, 24A and 25, 25A each include internally tapering, hooked end portions such as shown at 25', 25A' in FIG. 2 and which are integrally formed over at least a portion of the lengths of the ends of each retaining member. The purpose of these internally tapering hooked portions is to facilitate snapping and thereafter retaining a slide contact housing member into place over the insulator base member 21 as will be described more fully hereinafter.

The insulator base member 21 further includes integrally formed, stiffening channel portions shown at 26 and 27 in FIG. 3 of the drawings which extend between corresponding ones of the respective opposed sets of resilient side retaining members formed on the same side edge of the insulator base member 21. For example, channel portion 26 extends between corresponding resilient side retaining members 24 and 25 formed on the same edge of insulator base member 21 and 27 extends between resilient side retaining members 24A and 25A. The integrally formed, stiffening channel portions 26 and 27 are designed so that they extend in the direction away from the upper, opposite flat surface of insulator base member 21 but for a lesser distance than the resilient side retaining members 24, 25 and 24A, 25A as best seen in FIG. 1. By reason of the use of the resilient side retaining members 24, 25 and 24A, 25A and the stiffening channel portions 26 and 27 which are integrally formed on the side edges of the flat insulator base member 21, molded fabrication of the base member is still relatively simple and inexpensive but the base member is greatly strengthened in the vertical plane so that it is much less subject to fracture or bending while the switch is being operated in service than known caseless switches of comparable capabilities and cost.

The caseless, slide-action electric switch is further comprised by at least one, electrically conductive, slide contact member 31 best seen in FIG. 4 of the drawings. Slide contact member 31 is slidably supported on the opposite, upper surface of the flat insulator base member 21 for engaging the ends 23 of the respective electric terminals 22A, 22B, 22C. The particular slide contact member 31 shown in FIG. 4 is referred to as a slug contact and comprises a circular member of conductive metal having an upper cylindrical boss and a lower integral rim portion having a lower, flat "smooth contact" surface of sufficient diameter to bridge between the adjacent ends 23 of two of the contact members such as 22A and 22B, for example. While thus disposed, the contact member 31 forms a closed electrically conducting path through the two terminals. In the position shown in FIG. 4, no electrically conducting path is formed between contact members 22B and 22C and the electrical circuit between these two terminals is broken. However, if the switch were moved to the right so that the contact member 31 bridged between terminals 22B and 22C, a closed electrically conducting path would be made between these two terminals and the path through terminals 22A and 22B would be broken.

In order to retain the slide contact member 31 in position on the opposite, upper surface of insulator base member 21, a slidable contact housing member 41 of molded insulating material such as thermoplastic, is provided having at least one cavity (shown at 42) formed therein for retaining the slide contact member 31. The slidable contact housing member 41 is so proportioned that its upper surface is engaged by the undersides of internally tapering hooked end portions 24', 24A' and 25', 25A' of the resilient side retaining members as best seen in FIG. 2 of the drawings. By this means, the slidable contact housing member 41 is slidably retained in place over the upper, opposite surface of the insulator base member 21 by coaction of the sets of opposed, resilient slide contact housing side retaining members 24, 24A and 25, 25A and provides for movement of the slide contact member 31 between the alternate positions described in the preceding paragraph.

The slidable contact member 41 preferably includes a specially formed, extended readily accessible lever in the form of an upwardly extending boss 43 having a knurled or other surface 44 for ready engagement by an operator of the switch whereby the slidable contact housing member 41 may be moved or slid back and forth between the extreme left position shown in solid lines in FIG. 1 of the drawings, or to the extreme right position shown in dotted lines in FIG. 1. The raised, upwardly extending boss 43 of slidable contact member 41 includes an extension 42' of the cavity 42 in which a coil compression spring 45 is seated around the upper cylindrical boss on slug contact 31 so that it acts upwardly against the upper surface of cavity 42 and downwardly against the brim portion of slug contact member 31. The resultant reaction is to firmly press the contact member 31 into engagement with the end portions 23 of terminals 22A, 22B, 22C and simultaneously pressures the upper edge portion of the slide contact housing member 41 into firm engagement with the lower surfaces of the hooked end portions 24', 24A', 25', 25A'. As a result the slide contact housing member 41 together with slide contact 31 and spring 45 are firmly but slidably retained in place over the upper opposite flat surface of insulator base member 21 between the resilient side retaining members 24, 24A and 25, 25A. By this means, it is not necessary to maintain extremely close tolerances during fabrication of the parts between the thickness of the slide contact housing member 41 and the distances between the hooked end portions of the resilient side retaining members and the upper flat surface of insulator base member 21.

The width of the slide contact housing member 41 is so proportioned that housing member 41 will just fit between the lower inside surfaces of the resilient side retaining members 24, 24A and 25, 25A as well as the side channel portions 26 and 27. The resilient side retaining members are sufficiently resilient so that during assembly with the base member 21 up and side retaining members 24–25A pointing down, the slide contact housing member 41 together with the contact member 31 and coil spring 45 contained therein in an upside down manner, can be pressed vertically upward between the internally tapering hooked end portions into the space between the resilient side clamping members. The resilient side clamping members are bent outwardly temporarily during the assembly to accommodate housing member 41 and thereafter snap back into place upon member 41 becoming properly positioned in place over base member 21 as shown in FIG. 4. Thus assembly of the slide switch is facilitated and may be accomplished by relatively unskilled help after fabrication of the component parts in the above-described manner.

In order to stop the particular caseless, slide-action switch embodiment shown in FIGS. 1 through 4, a set of integrally formed, side lugs or bosses shown at 46 and 46A in FIG. 3 of the drawings, are provided on the upper intermediate sides of the slide contact housing member 41 so as to extend into the space over the channel portions 26 and 27 between the inside edges of the outer ends of the resilient side retaining members 24, 24A and 25, 25A in the manner best seen in FIG. 1 of the drawings considered in conjunction with FIG. 3. The bosses 46, 46A are proportioned to stop the slide housing member 41 in its left-hand position as shown by solid lines 43 and 44 in FIG. 1, by engaging the inner edges of the outer ends of resilient side retaining members 24 and 24A. In the alternate position of the switch, as shown by dotted lines in FIG. 1, the opposite edge of the bosses 46 and 46A engage the inner edges of the outer portions of the resilient slide retaining members 25 and 25A thereby restraining movement of the slide contact housing member 41 and slide contact 31 between predetermined end positions corresponding to different conditions for the switch. For example, depending upon the use intended for the switch, the two positions could correspond to on-off conditions for the switch or to double throw positions whereby it would close alternate ones of two different electrically conductive paths. If desired, only a single boss such as 46 could be formed on the body of the slide contact housing member 41 and the boss 46A on the opposite side thereof deleted thereby resulting in some material savings. Finally, in order to physically mount the caseless slide switch in place on a supporting structure, openings or holes 20 are provided at each end of insulator base member 21.

FIGS. 5 and 6 of the drawings illustrate a caseless, slide-action electric switch according to the invention wherein integrally formed mounting bosses shown at 28 are molded onto the ends of the insulator base member 21. With this arrangement, the switch may be readily mounted to the backside of a suitable mounting panel 47 which has an opening therein through which the boss 43 and knurled surface 44 protrude in order that the switch can be operated from the front side of the panel.

FIG. 7 is a side elevational view of still another modification of the switch suitable for use with printed circuit boards. In the arrangement of FIG. 7, integrally formed hook members or legs 29 are provided which depend from the flat insulator base member 21 in a direction opposite from the resilient side members 24 and 25, etc. The integral, depending hook members 29 are designed to be inserted through suitable slots formed in a printed circuit board such as that illustrated in phantom at 30 whereby the switch may be physically mounted on the printed circuit board. By appropriate design of the depending hook members, they might also be used as stand-offs. If the depending hook members (legs) 29 are used, the ends of the insulator base member 21 need not be extended beyond the ends of the resilient sidewall members 24, 24A and 25, 25A to accommodate openings or mounting bosses.

FIG. 8 is a partial sectional view of a modified form of a caseless slide-action electric switch according to the invention which employs a self-detenting contact arrangement. In FIG. 8, like parts to those described with relation to FIGS. 1 through 4 have been identified with the same reference character and function in precisely the same manner. In the arrangement of FIG. 8, however, the bottom of the slug contact 31 is provided with a pimple 51 which is centrally disposed on the bottom surface of the contact as best shown in FIG. 9. The pimple 51 coacts with the raised end 23 of each of the terminals 22A, 22B and 22C extending through the flat insulator base member 21 and is designed such that it rides up against the force of coil spring 45 over the central raised end 23 of terminal 22B while the switch is moved from left to right or vice versa. After clearing the central position, the force of spring 45 causes the pimple or projection 51 on the bottom of slug contact member 31 to settle in the space between adjacent ends 23 of the terminals 22A and 22B, for example. Thus the pimple 51 operates as a detent to hold the slug contact 31 in the position to which it has been moved by an operator of the switch. In a similar fashion, if the slide contact housing member 41 were moved to the right by an operator of the switch, the pimple 51 would ride over the central terminus 23 of terminal 22B and settle into the space between the ends of terminals 22B and 22C thereby causing the slug contact 31 to bridge between these two terminals.

FIG. 10 is a partial sectional view of still another sliding contact arrangement suitable for use with the novel switch made available by the invention. In the slide-action, caseless switch shown in FIG. 10, a spring contact member 61 is employed in place of the slug contact and coil spring required with the switches shown in FIGS. 1–9. The spring contact member 61 is illustrated in greater detail in FIG. 11 and comprises an essentially horseshoe-shaped member made of a resilient metal material and open at one end so as to form essentially two spring arms 61A and 61B. The spring arms 61A and 61B are bent towards each other and are designed to engage and be compressed by the top of the molded slide contact housing member 41 so as to pressure the bottom of the contact member 61 into positive engagement with the contact points 23 on the ends of the terminals 22A, 22B, 22C and 22D. In the switch shown in FIGS. 10 and 11, a pimple or projection 62 is formed in the center of the spring contact member 61 and functions in the same manner as the pimple 51 provided with the slide contact arrangement shown in FIG. 8 to detent the switch. Additionally, it should be noted that the switch shown in FIG. 10 comprises a multiposition switch having three or more switch positions representing different conditions for the switch. For this reason the additional terminal 22D is provided. If desired, additional terminals could be included and the switch base member extended to accommodate them whereby 4, 5, 6, 7, etc. multiposition switches can be made available. In any such multiposition switches, it is usually necessary that detenting be provided as shown at 62 in FIG. 10 in order that the switch contact stay in any given position to which it has been set by an operator.

FIGS. 12, 13 and 14 of the drawings illustrate still different forms of spring contact members 61, 71 and 81, respectively, which could be used with either embodiment of the invention shown in FIGS. 4 and 8 or FIG. 10 with or without the use of a pimple formed on its bottom surface for self-detenting depending upon whether multiple switch positions are provided as was described with relation to FIGS. 10 and 11. FIG. 12 is a smooth contact surface version of the spring contact shown in FIG. 10 and FIG. 11 for use in two or more position switches. In FIG. 13, the spring contact side arms 71A and 71B of spring contact 71 are tapered towards their free end in order to control the degree of resiliency provided to these spring contact arms. In other respects, the spring contact member of FIG. 13 would be used in a slide-action switch structure similar to that illustrated in FIG. 10.

FIG. 14 of the drawings is a perspective view of still another form of slide action, spring contact member 81 and is referred to as a cross-over type spring contact. With this spring contact, the spring contact arms 81A and 81B are disposed to one side of each other to provide longer spring arms. In other respects, the contact would be mounted in substantially the same fashion as described with relation to FIG. 10 and would function in a similar manner.

Figure 16:
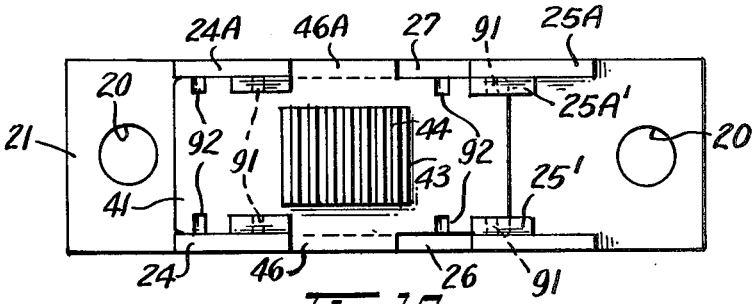
Figure 17:
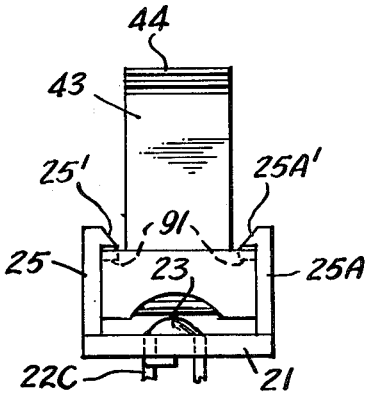

FIGS. 15 through 17 of the drawings illustrate an embodiment of the switch according to the invention wherein smooth surface slide contact members such as those illustrated in FIG. 4, FIG. 12, FIG. 13 and FIG. 14 of the drawings can be employed and still provide the switch with detenting means whereby the slide contact member can be accurately positioned and detained in a desired one of a number of switching positions. FIG. 15 is a partial longitudinal-sectional view of the switch showing one side only of the insulator base member together with the upright, resilient side retaining members 24A and 25A and the interconnecting stiffening channel portion 27. FIG. 16 is a top plan view of the switch shown in FIG. 15 and FIG. 17 is an end elevational view of the switch. In this switch embodiment, detenting is provided by means of a set of integral detent bosses 91 which are formed on the under surface of the outer hooked end portions 24', 25', 24A' and 25A' of the resilient side retaining members 24–25A, respectively. The detent bosses 91 are formed so they extend transversely to the width of the insulator base member 21 and hence transversely to the path of sliding movement of the slide contact housing member 41. The slidable contact housing member 41 has a set of coacting detent recesses, best seen at 92 in FIGS. 15 and 16, which are integrally formed in the upper surface of the slidable contact housing member 41 along the outer upper edges near each end of member 41. To assure ease of switching action the vertical height of the slidable contact housing member should be dimensioned to provide a gap between the bottom surface of contact housing member 41 and the top surface of insulator base member 21 which is slightly greater than the height of the detent bosses 91.

It should be noted that the positioning of the switch as shown in FIGS. 15 and 16 is such that the coacting detent recesses disposed under the detent bosses 91 are not readily viewed but nevertheless are present and serve to retain the slide contact housing member 41 in its left-hand position shown in FIGS. 15 and 16 as viewed by the reader. Operation of the switch to move the slide contact housing member 41 to the right from the position shown would result in positioning the recesses shown at 92 in FIGS. 15 and 16 underneath and in engagement with the detent bosses 91. By this construction, the active positions of the switch are positively detented without requiring the use of a detent boss such as that shown at 51 in FIG. 9 or 62 in FIG. 11 on the under surface of the slide contact member. As a result, the slide contact member employed with the embodiment of the switch shown in FIGS. 15–17 may have a smooth contact surface such as those depicted in FIG. 4, FIG. 12, FIG. 13 and FIG. 14. Consequently, the switch may be changed from one position to another smoothly without the bounce and chatter that normally accompanies movement of a detented contact member thereby producing less arcing during the making and breaking of an electric circuit with which the switch is used. While the switch embodiment shown in FIGS. 15–17 has been illustrated in connection with a two-position switching application in mind, it should be understood that by appropriate layout and design of the detent bosses 91 and coacting detent recesses 92, any desired number of switching positions for a multiposition switch can be provided within practical limits. The range of movement provided by the layout of the detent bosses and recesses should be limited to be within the range of movement allowed by the stop bosses.

From the foregoing description, it will be appreciated that the invention provides a family of new and improved, low cost, miniaturized, caseless, slide-action electric switches which employ a minimum number of relatively simple and inexpensive to fabricate component parts, are easy to assemble during manufacture, and yet are comparatively rugged and durable after assembly so as to provide reliable operation in service.

Having described several embodiments of a new and improved, low cost, caseless electric switch constructed according to the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. A caseless slide-action electric switch comprising:
(a) a relatively thin flat insulator base member of substantially uniform thickness throughout its length and breadth and having a plurality of electric terminal means with the ends extending through one of the flat surfaces thereof and engagable from the opposite flat surface thereof;
(b) said insulator base member including at least two sets of opposed, resilient slide contact housing side retaining members integrally formed on the respective side edges near the ends of the insulator base member and extending outwardly in a direction normal to the said opposite flat surface on the same side of the insulator base member as said opposite flat surface, said side retaining members comprising part of a pair of outer side walls for the caseless electric switch and having retaining means formed thereon;
(c) said insulator base member further including integrally formed stiffening channel portions extending between corresponding side retaining members of the respective opposed sets formed on the same side edge of said insulator base member and in conjunction with the side retaining members forming outer side walls for the caseless electric switch;
(d) at least one electrically conductive slide contact member slidably supported on the said opposite flat surface of said insulator base member for engaging respective electric terminal means and making or breaking electrically conducting paths therethrough;
(e) a slidable contact housing member of insulating material having at least one cavity formed therein for retaining said slide contact member in place on the said opposite flat surface of said insulator base member, said slidable contact housing member being engaged by and slidably retained in place on the said opposite surface of said insulator base member by the retaining means formed on said sets of opposed resilient slide contact housing side retaining members; and
(f) stop means interacting with said slidable contact housing member and said slide contact member for restraining movement of said slide contact member between predetermined end positions.

2. A caseless slide-action electric switch according to claim 1 further including detent means coacting with said slidable contact housing member and said slide contact member for detenting said slide contact member in a selected one of a multiplicity of operating positions.

3. A caseless slide-action electric switch according to claim 1 wherein said slidable contact housing member includes a specially formed, extended readily accessible operating lever on an externally available surface thereof for engagement by an operator of the switch.

4. A caseless slide-action electric switch according to claim 1 wherein the resilient slide contact housing side retaining members have internally tapering hooked end portions formed at the ends thereof which comprise the retaining means for readily snapping the slidable contact housing member into place over the said opposite flat surface of said insulator base member and thereafter slidably retaining the contact housing member along with the slide contact member mounted in position on the insulator base member.

5. A caseless slide-action electric switch according to claim 1 wherein said stop means comprises a boss of integrally formed insulator material on the slide contact housing member and said integrally formed stiffening channel portions of said insulator base member are of lesser extent than said slide contact housing side retaining members whereby upon snapping said slide contact housing member into place over the insulator base member said boss extends into the space between corresponding side retaining members on the same side edge of the insulator base member and rides above the stiffening channel portion in a manner such that the boss engages and is stopped by the internally opposed sides of the side retaining members at the respective opposite ends of travel of the slide contact housing member.

6. A caseless slide-action electric switch according to claim 2 wherein said slidable contact housing member includes a specially formed readily accessible lever on an external available surface for ready engagement by an operator of the switch and wherein the resilient slide contact housing side retaining members have internally tapering hooked end portions formed at the ends thereof for readily snapping the slidable contact housing member into place over the said opposite flat surface of said insulator base member and thereafter slidably retaining the contact housing member along with the slide contact member mounted in position on the insulator base member.

7. A caseless slide action electric switch according to claim 6 wherein said stop means comprises a boss of integrally formed insulator material on the slide contact housing member and said integrally formed stiffening channel portions of said insulator base member are of lesser extent than said slide contact housing side retaining members whereby upon snapping said slide contact housing member into place over the insulator base member said boss extends into the space between corresponding side retaining members on the same side edge of the insulator base member and rides above the stiffening channel portion in a manner such that the boss engages and is stopped by the internally opposed sides of the retaining members at the respective opposite ends of travel of the slide contact housing member.

8. A caseless slide-action electric switch according to claim 2 wherein the detent means comprises a set of integral detent bosses formed on the inside surfaces of the resilient slide contact housing side retaining members and coacting with detent recesses formed on the slidable contact housing member and the slide contact member has a smooth surface contacting the engagable ends of the electric terminal means.

9. A caseless slide-action electric switch according to claim 7 wherein the detent means comprises a set of integral detent bosses formed on the inside surfaces of the slide contact housing side retaining members and coacting with detent recesses formed on the slidable contact housing member and the slide contact member has a smooth surface contacting the engagable ends of the electric terminal means.

10. A caseless slide-action electric switch according to claim 2 wherein the detent means comprises a pimple formed on the under surface of the slide contact member and which coacts with the engagable ends of the terminal means for detenting the slide contact member and its housing in a position to which it is moved by an operator of the switch.

11. A caseless slide-action electric switch according to claim 7 wherein the detent means comprises a pimple formed on the under surface of the slide contact member and which coacts with the engagable ends of the terminal means for detenting the slide contact member and its housing in a position to which it is moved by an operator of the switch.

12. A caseless slide-action electric switch according to claim 1 wherein said slide contact member comprises a circular slug contact and the switch further includes a coil spring disposed in the cavity in said slidable contact housing member between the slug contact and the roof of the cavity for pressing said slug contact into engagement with the ends of the terminal members extending through one surface of the insulator base member and engagable from the upper opposite flat surface thereof.

13. A caseless slide-action electric switch according to claim 9 wherein said slide contact member comprises a circular slug contact and the switch further includes a coil spring disposed in the cavity in said slidable contact housing member between the slug contact and the roof of the cavity for pressing said slug contact into engagement with the ends of the terminal members extending through one surface of the insulator base member and engagable from the upper opposite flat surface thereof.

14. A caseless slide-action electric switch according to claim 11 wherein said slide contact member comprises a circular slug contact and the switch further includes a coil spring disposed in the cavity in said slidable contact housing member between the slug contact and the roof of the cavity for pressing said slug contact into engagement with the ends of the terminal members extending through one surface of the insulator base member and engagable from the upper opposite flat surface thereof.

15. A caseless slide-action electric switch according to claim 1 wherein said slide contact member is a combined spring and slide contact member for acting against the roof of the cavity in the slidable contact housing member and pressuring the slide contact member into good electrical contact with the ends of the electric terminal means extending through the insulator base member.

16. A caseless slide-action electric switch according to claim 9 wherein said slide contact member is a combined spring and slide contact member for acting against the roof of the cavity in the slidable contact housing member and pressuring the slide contact member into good electrical contact with the ends of the electric terminal means extending through the insulator base member.

17. A caseless slide-action electric switch according to claim 11 wherein said slide contact member is a combined spring and slide contact member for acting against the roof of the cavity in the slidable contact housing member and pressuring the slide contact member into good electrical contact with the ends of the electric terminal means extending through the insulator base member.

18. A caseless slide-action electric switch according to claim 3 further including integral switch mounting bosses formed on the upper opposite surface of the insulator base member and slightly greater in height than the resilient side retaining members for physically mounting the switch on the back side of a mounting panel with the extended operators lever accessible through an opening in the mounting panel.

19. A caseless slide-action electric switch according to claim 3 further including a plurality of depending legs having snap-in hooks on the ends thereof integrally formed on the insulator base member to extend in a direction opposite to the direction of said slide contact housing side retaining members for mounting the switch on a printed circuit board.

20. A caseless slide-action electric switch according to claim 13 further including integral switch mounting bosses formed on the upper opposite surface of the insulator base member and slightly greater in height than the resilient side retaining members for physically mounting the switch on the back side of a mounting panel with the extended operators lever accessible through an opening in the mounting panel.

21. A caseless slide-action electric switch according to claim 13 further including a plurality of depending legs having snap-in hooks on the ends thereof integrally formed on the insulator base member to extend in a direction opposite to direction of said slide contact housing side retaining members for mounting the switch on a printed circuit board.

22. A caseless slide-action electric switch according to claim 14 further including integral switch mounting bosses formed on the upper opposite surface of the insulator base member and slightly greater in height than the resilient side retaining members for physically mounting the switch on the back side of a mounting panel with the extended operators lever accessible through an opening in the mounting panel.

23. A caseless slide-action electric switch according to claim 14 further including a plurality of depending legs having snap-in hooks on the ends thereof integrally formed on the insulator base member to extend in a direction opposite to the direction of said slide contact housing side retaining members for mounting the switch on a printed circuit board.

24. A caseless slide-action electric switch according to claim 16 further including integral switch mounting bosses formed on the upper opposite surface of the insulator base member and slightly greater in height than the resilient side retaining members for physically mounting the switch on the back side of a mounting panel with the extended operators lever accessible through an opening in the mounting panel.

25. A caseless slide-action electric switch according to claim 16 further including a plurality of depending legs having snap-in hooks on the ends thereof integrally formed on the insulator base member to extend in a direction opposite to the direction of said slide contact housing side retaining members for mounting the switch on a printed circuit board.

26. A caseless slide-action electric switch according to claim 17 further including integral switch mounting bosses formed on the upper opposite surface of the insulator base member and slightly greater in height than the resilient side retaining members for physically mounting the switch on the back side of a mounting panel with the extended operators lever accessible through an opening in the mounting panel.

27. A caseless slide-action electric switch according to claim 17 further including a plurality of depending legs having snap-in hooks on the ends thereof integrally formed on the insulator base member to extend in a direction opposite to the direction of said slide contact housing side retaining members for mounting the switch on a printed circuit board.

* * * * *